US011464257B2

(12) United States Patent
Ouyang

(10) Patent No.: US 11,464,257 B2
(45) Date of Patent: Oct. 11, 2022

(54) ELECTRONIC CIGARETTE

(71) Applicant: HONG KONG IVPS INTERNATIONAL LIMITED, Central (HK)

(72) Inventor: Junwei Ouyang, Shenzhen (CN)

(73) Assignee: HONG KONG IVPS INTERNATIONAL LIMITED, Central (HK)

( * ) Notice: Subject to any disclaimer, the term of this patent is extended or adjusted under 35 U.S.C. 154(b) by 238 days.

(21) Appl. No.: 16/910,152

(22) Filed: Jun. 24, 2020

(65) Prior Publication Data

US 2020/0404964 A1 Dec. 31, 2020

(30) Foreign Application Priority Data

Jun. 29, 2019 (CN) ..... 201910582488.6

(51) Int. Cl.
*A24F 40/40* (2020.01)

(52) U.S. Cl.
CPC ..... *A24F 40/40* (2020.01)

(58) Field of Classification Search
CPC ..... A24F 40/40; A24F 40/90
See application file for complete search history.

(56) References Cited

U.S. PATENT DOCUMENTS 10,045,567 B2 * 8/2018 Monsees ..... H02J 7/0044
2014/0202475 A1 * 7/2014 Liu ..... A24F 40/40 131/329
2014/0261495 A1 * 9/2014 Novak, III ..... H05B 3/46 392/386
2015/0053217 A1 * 2/2015 Steingraber ..... A24F 40/50 131/329
2015/0245668 A1 * 9/2015 Memari ..... A24F 40/50 206/250
2017/0027228 A1 2/2017 Rastogi
2017/0079327 A1 * 3/2017 Wu ..... H05B 1/0244
2017/0099877 A1 * 4/2017 Worm ..... A61M 11/042
(Continued)

FOREIGN PATENT DOCUMENTS

CN 109303355 A 2/2019
WO 2015/161406 A1 10/2015

OTHER PUBLICATIONS

European Patent Office, European Search Report and Search Opinion, European Patent Application No. 20182824.1, 7 pages, dated Nov. 16, 2020.

*Primary Examiner* — Truc T Nguyen
(74) *Attorney, Agent, or Firm* — Thompson Hine LLP

(57) ABSTRACT

The present disclosure discloses an electronic cigarette, including a power supply device with an installation groove and an atomizing device; either the installation groove or the atomizing device is provided with a protruded elastic buckle, and the elastic buckle can be slid perpendicularly along the installation direction of the atomizing device; the other one is provided with a buckle slot matching the elastic buckle. When the atomizing device is installed into the installation groove, the elastic buckle will be engaged in the buckle slot to form a disassemble connection between the atomizing device and the power supply device. When the elastic buckle is slid, the elastic buckle will come out of the buckle slot, so that the atomizing device can be taken out from the installation groove.

20 Claims, 6 Drawing Sheets

(56) References Cited

U.S. PATENT DOCUMENTS

| | | | | |
|---|---|---|---|---|
| 2017/0150757 | A1* | 6/2017 | Worm | H05B 1/0244 |
| 2017/0196264 | A1* | 7/2017 | Liu | A24F 40/60 |
| 2018/0279676 | A1* | 10/2018 | Kalish | A24F 40/485 |
| 2018/0310614 | A1* | 11/2018 | Xu | A61M 15/06 |
| 2019/0183179 | A1* | 6/2019 | Fortkort | A24B 15/167 |
| 2020/0000146 | A1* | 1/2020 | Anderson | H01R 13/6205 |
| 2021/0260312 | A1* | 8/2021 | Lacour-Gayet | A61M 15/0013 |
| 2022/0015422 | A1 | 1/2022 | Zhao et al. | |

* cited by examiner

ELECTRONIC CIGARETTE

CROSS-REFERENCE TO RELATED APPLICATION

This application claims priority to Chinese Patent Application No. 201910582488.6, filed on Jun. 29, 2019. The disclosure of the foregoing application is incorporated herein by reference in its entirety.

TECHNICAL FIELD

This disclosure relates to the technical field of electronic cigarettes, particularly an electronic cigarette.

BACKGROUND

Existing electronic cigarettes include integrated electronic cigarettes and split electronic cigarettes. For the split electronic cigarettes, the power supply device and the atomizing device are assembled in a disassemble manner. The atomizing device will be installed onto the power supply device when the electronic cigarette is used. Generally, the power supply device is provided with an installation groove for installing the atomizing device, and the atomizing device is fastened by the manner of magnetic attraction or interference fit to prevent the atomizing device from falling out of the installation groove. However, for the method of magnetic attraction, the magnetic force should match the atomizing device; in addition, its cost is relatively high. For the method of interference fit, the force of interference fit is hard to be controlled, making the connection either over-tight or over-loose, which may cause the atomizing device to be taken out too easily or too hard. Therefore, the existing technology needs to be modified and improved.

SUMMARY

The main purpose of present disclosure is to provide an electronic cigarette with a connection structure between the atomizing device and the power supply device; it will improve reliability of the connection between the two devices and be convenient for use simultaneously.

To achieve above objectives, technical solutions adopted by the present disclosure are as following:

An electronic cigarette, characterized in that it includes a power supply device with an installation groove and an atomizing device; either the installation groove or the atomizing device is provided with a protruded elastic buckle, and the elastic buckle can be slid perpendicularly along the installation direction of the atomizing device; the other one is provided with a buckle slot matching the elastic buckle. When the atomizing device is installed into the installation groove, the elastic buckle will be engaged in the buckle slot to form a disassemble connection between the atomizing device and the power supply device. When the elastic buckle is slid, the elastic buckle will come out of the buckle slot, so that the atomizing device can be taken out from the installation groove.

The electronic cigarette, wherein the installation groove is provided with an installation base for installing the elastic buckle; the installation base is provided with a receiving groove facing the installation groove, and partial the elastic buckle locates inside the receiving groove and elastically abuts against the bottom wall of the receiving groove. Under an external force, the elastic buckle will slide along the extending direction of the receiving groove.

The electronic cigarette, wherein the elastic buckle includes a body, an elastic element connecting to one side of the body, and a buckle part connecting to the other side of the body. The elastic element completely locates inside the receiving groove and elastically abuts against the body and the bottom wall of receiving groove, respectively. The buckle part protrudes from the receiving groove and locates inside the installation groove. When the body slides under a force, the buckle part will be pulled out/buckled into the buckle groove.

The electronic cigarette, wherein the side of the body connecting to the elastic element is provided with at least one first limiting element, and the bottom wall of receiving groove is provided with a first limiting hole matching the first limiting element. The end of the first limiting element away from the body locates inside the first limiting hole and is engaged with it to limit any displacement of the elastic buckle along the extending direction of receiving groove.

The electronic cigarette, wherein the side of the body connecting to the elastic element is further provided with a second limiting element and the inner wall of the receiving groove is provided with a second limiting hole matching the second limiting element. The second limiting element locates inside the second limiting hole to limit any perpendicular displacement of the elastic element along the extending direction of receiving groove.

The electronic cigarette, wherein the second limiting element is an U-shape limiting element protruding from the outer side of the body, and the second limit hole is a corresponding U-shape hole.

The electronic cigarette, wherein there are two first limiting elements. The two first limiting elements are symmetrically set at both ends of the body to form a guiding groove with the body, the second limiting element, and the receiving groove; the elastic element locates inside the guiding groove.

The electronic cigarette, wherein the body is provided with a handle part; the handle part is exposed from the receiving groove to form a sliding groove with the body; partial side of the receiving groove locates inside the sliding groove. When the handle part slides under an external force, the sliding groove will slide along the side wall of the receiving groove.

The electronic cigarette, wherein the surface of the handle part exposed from the receiving groove is provided with at least one notch.

The electronic cigarette, wherein the notch of the receiving groove and the inner wall of installation groove are at the same level.

Advantages: The present disclosure provides an electronic cigarette, characterized in that it includes a power supply device with an installation groove and an atomizing device; either the installation groove or the atomizing device is provided with a protruded elastic buckle, and the elastic buckle can be slid perpendicularly along the installation direction of the atomizing device; the other one is provided with a buckle slot matching the elastic buckle. When the atomizing device is installed into the installation groove, the elastic buckle will be engaged in the buckle slot to form a disassemble connection between the atomizing device and the power supply device. When the elastic buckle is slid, the elastic buckle will come out of the buckle slot, so that the atomizing device can be taken out from the installation groove. In the present disclosure, the disassemble connection between the atomizing device and the power supply device are formed through the engagement between the elastic buckle and its slot, which will improve the reliability of such connection between the two devices as well as be convenient for use.

DESCRIPTION OF DRAWINGS

To explain the technical solutions more clearly in embodiments of this present disclosure or the prior art, drawings used in the instruction of embodiments or the prior art are briefly introduced as below. Obviously, drawings in the following instruction are only used for some embodiments of this present disclosure. For those of ordinary skill in the art, other drawings can be obtained without any creative effort based on the structure shown in these drawings.

INSTRUCTION OF DRAWING LABELS

Figure 1:
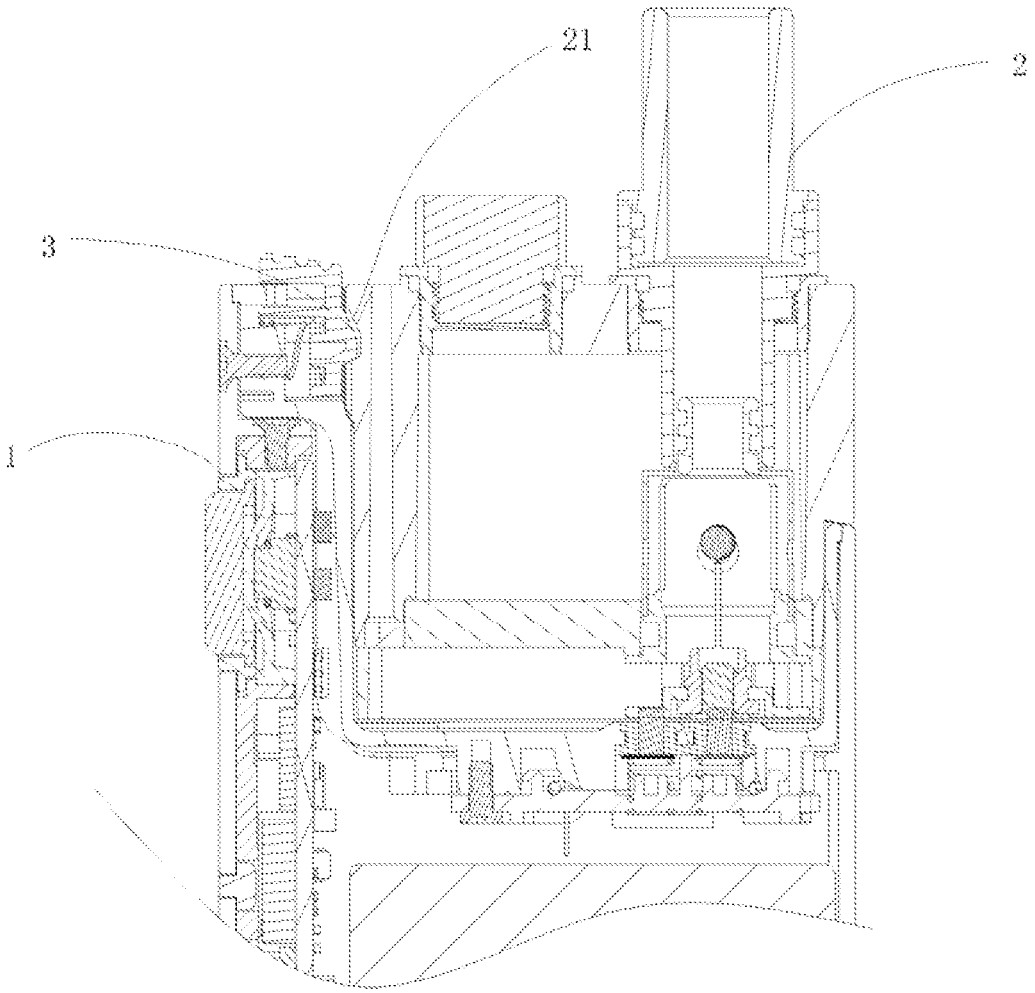
FIG. 1 is a cross-sectional view of electronic cigarette's embodiment preferred in the present disclosure.

| Label | Name | Label | Name |
|---|---|---|---|
| 1 | Power supply device | 2 | Atomizing device |
| 3 | Elastic buckle | 4 | Guiding groove |
| 11 | Installation hole | 12 | Installation base |
| 13 | Receiving groove | 121 | First limiting hole |
| 122 | First step | 123 | Second step |
| 131 | Bottom wall | 132 | First side wall |
| 133 | Second side wall | 134 | Third side wall |
| 21 | Buckle slot | 31 | Body |
| 32 | Buckle part | 33 | Elastic element |
| 34 | First limiting element | 35 | Second limiting element |
| 36 | Handle part | 37 | Sliding groove |
| 321 | Guiding surface | 341 | L-shape buckle |
| 361 | Notch | 135 | Second limiting hole |

The purpose, functional characteristics, and advantages of the present disclosure will be further explained with the reference to embodiments and drawings.

DETAILED DESCRIPTION

The technical solutions in embodiments of present disclosure will be clearly and completely described as below with reference to drawings in embodiments of present disclosure. Obviously, any described embodiment is only a part of embodiments of this present disclosure, but not all of them. Based on the embodiments of present disclosure, any other embodiment obtained by a person of ordinary skill in the art without any creative efforts shall be within the protection scope of this present disclosure.

It should be noted that any directional indication (such as up, down, left, right, front, and back . . . ) in the embodiments of the present disclosure is only used to explain the relative positional relationship and movement of elements in a specific posture (as shown in drawings). If such specific posture changes, the directional indication will change accordingly.

In addition, the descriptions related to "first", "second", etc. in the present utility model are for descriptive purposes only and cannot be understood as any indication or implication of its relative importance or implicit indication of the number of technical features. Therefore, any feature defined as "first" or "second" may explicitly or implicitly includes at least one of features. In addition, any technical solutions in various embodiments can be combined with each other but must be realized by a person of ordinary skill in the art. When such combination of technical solutions shows conflicts or cannot be achieved, it should be considered as nonexistent and will not be within the protection scope claimed by this present disclosure.

In the present disclosure, the terms of "connected" and "fixed" shall be understood in a broad sense unless otherwise specified and defined; for example, "fixed" may be a fixed connection, a detachable connection, or an integral one; It can be a mechanical connection or an electrical connection; it also can be directly connected or indirectly connected through an intermediate medium; it also can be an internal connection of two elements or an interaction relationship between two elements, unless it is clearly defined otherwise. For those of ordinary skill in the art, they can explain specific meanings of above terms in the present disclosure according to the specific situation.

Figure 2:
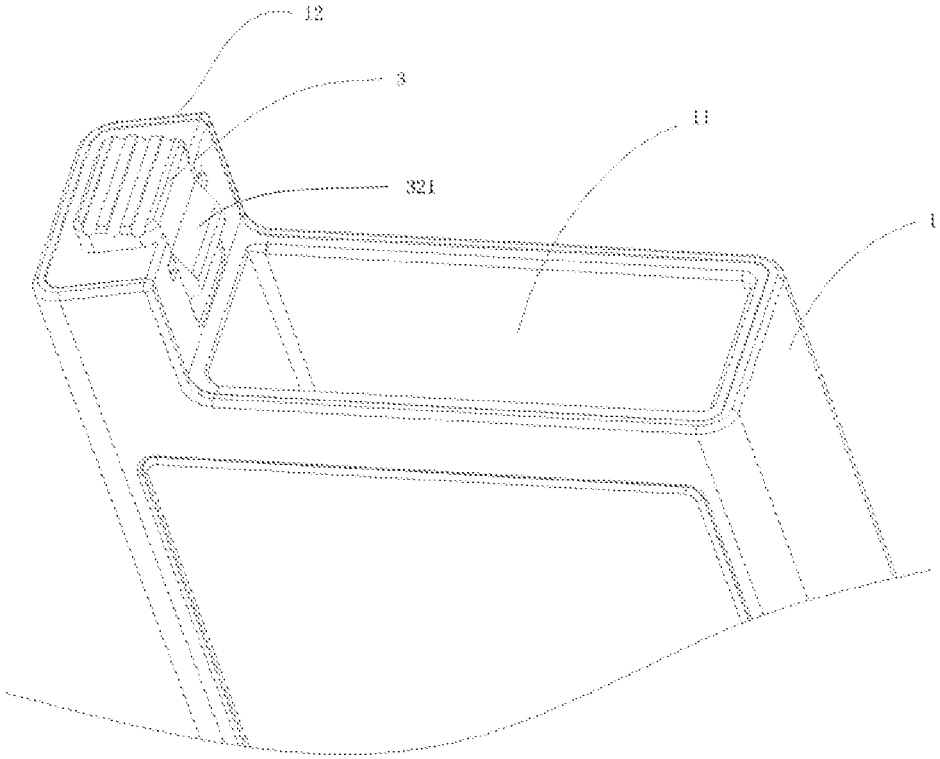
FIG. 2 is a perspective view of connection structure between the power supply device and the elastic buckle in the electronic cigarette's embodiment preferred in the present disclosure.

Please refer to FIG. 1 and FIG. 2, which are perspective views of electronic cigarette's embodiment preferred in the present disclosure; FIG. 2 is a perspective view of power supply device in the electronic cigarette's embodiment preferred in the present disclosure. The electronic cigarette includes a power supply device 1 with an installation groove 11 and an atomizing device 2; either the installation groove 11 or the atomizing device 2 is provided with a protruded elastic buckle 3, and the elastic buckle 3 can be slid perpendicularly along the installation direction of the atomizing device 2; the other one is provided with a buckle slot 21 matching the elastic buckle 3. When the atomizing device 2 is installed into the installation groove 11, the elastic buckle 3 will be engaged in the buckle slot 21 to form a disassemble connection between the atomizing device 2 and the power supply device 1. When the elastic buckle 3 is slid, the elastic buckle 3 will come out of the buckle slot 21, so that the atomizing device 2 can be taken out from the installation groove 11. In the present disclosure, the disassemble connection between the atomizing device 3 and the power supply device 1 are formed through the engagement between the elastic buckle 3 and its slot 21, which will improve the reliability of such connection between the two devices as well as be convenient for use.

Figure 3:
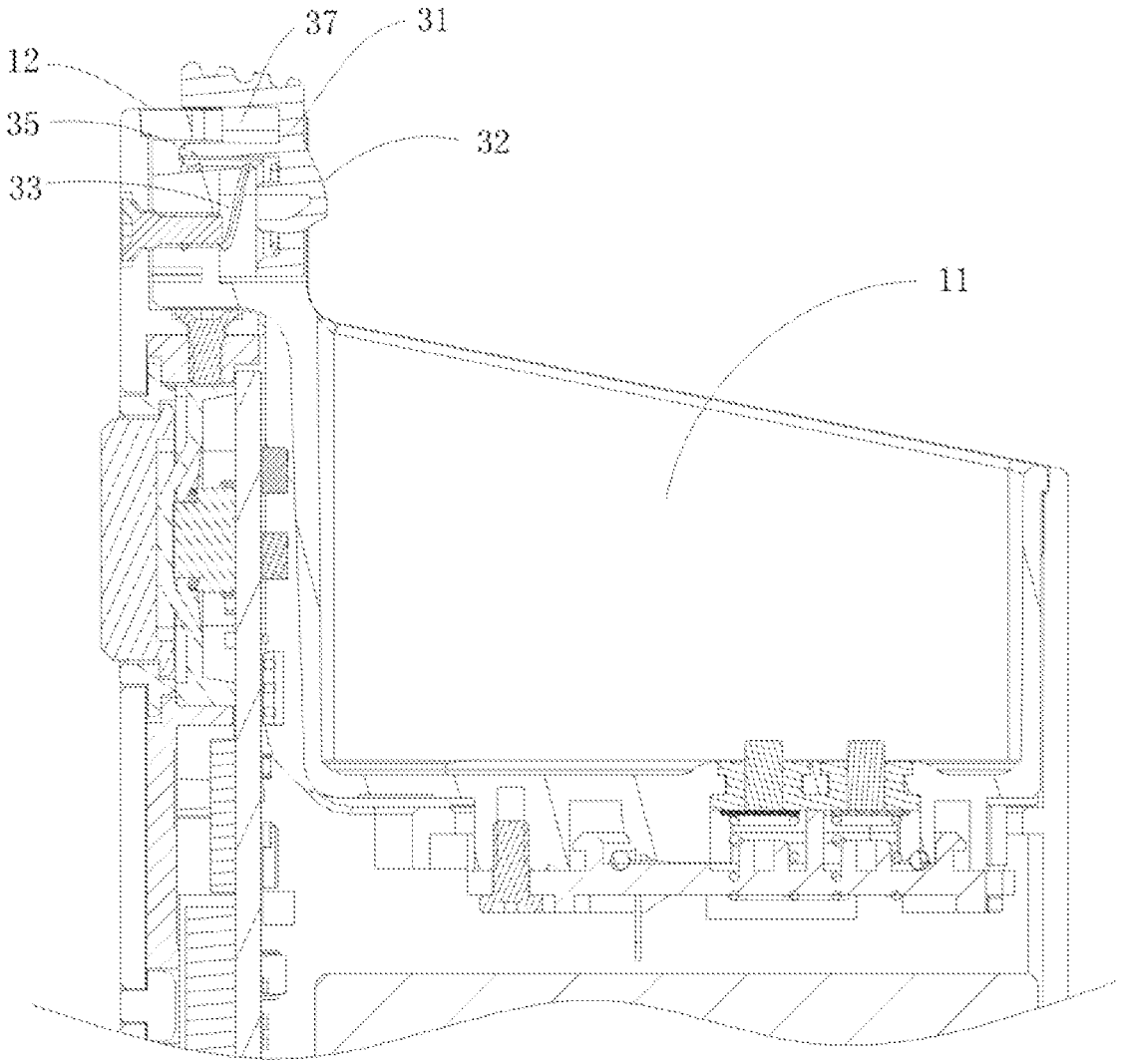
FIG. 3 is a first cross-sectional view of connection structure between the power supply device and the elastic buckle in the electronic cigarette's embodiment preferred in the present disclosure.
Figure 4:
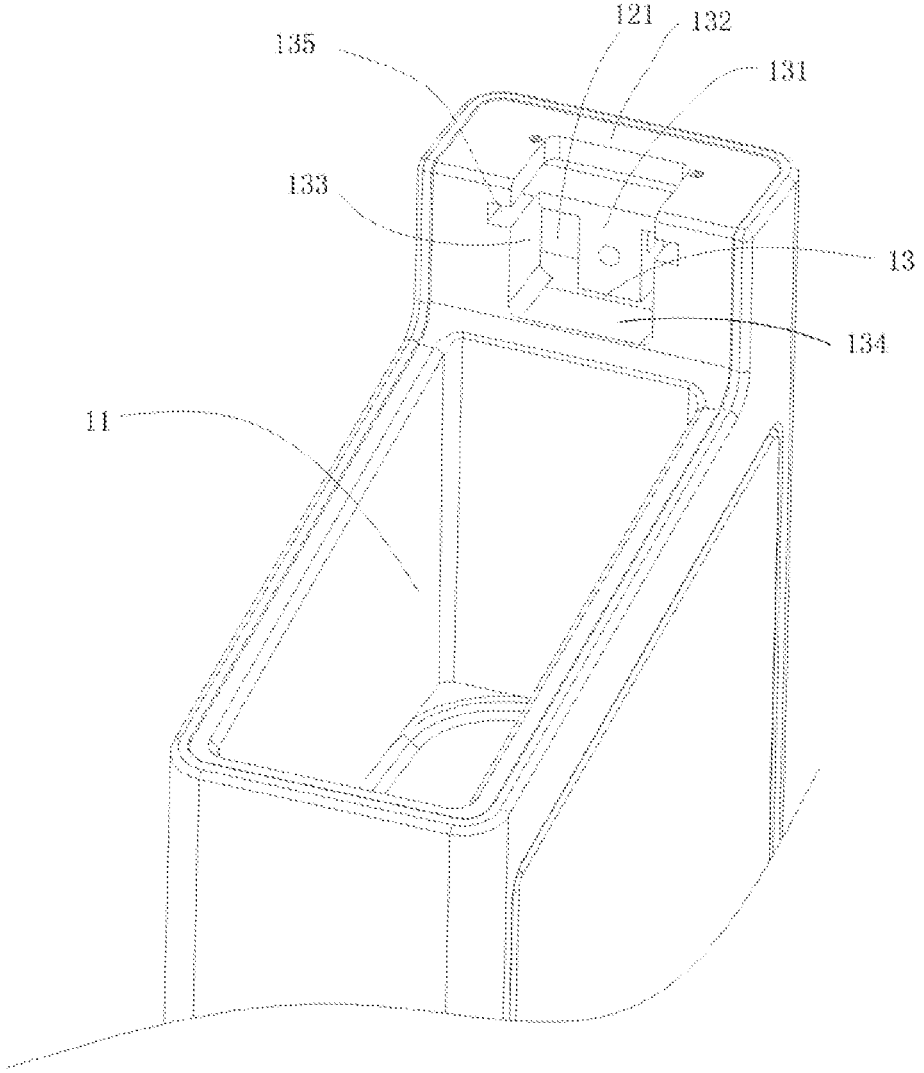
FIG. 4 is a perspective view of power supply device in the electronic cigarette's embodiment preferred in the present disclosure.

In this embodiment, as shown in FIGS. 2-4, the elastic buckle 3 locates inside the installation groove 11, and the buckle slot 21 locates in the atomization device 2 correspondingly. Specifically, the installation groove 11 is provided with an installation base 12 for installing the elastic buckle 3; the installation base 12 is provided with a receiving groove 13, which means the notch of the receiving groove 13 faces towards the installation groove 11. The receiving groove 13 includes a bottom wall 131, a first side wall 132, a second side wall 133, a third side wall 134, and a fourth side wall (not shown in the figure); the four side walls are connected in sequence and vertically connect to the bottom wall 131 respectively to enclose a quadrangular receiving groove 13. Wherein, the bottom wall 131 faces the notch of receiving groove 13, and the first side wall 132 and the second side wall 133 locate on both sides of the notch, respectively. Preferably, the notch of receiving groove 13 and the inner wall of installation groove 11 are at the same level, so that the inner wall of installation groove 11 will be a relatively flat surface, much easier for the subsequent assembly of the atomizing device 2. Partial the elastic buckle 3 locates inside the receiving groove 13 and partial the elastic buckle 3 protrudes from the receiving groove 13 to locate inside the installation groove 11; the part locating inside the receiving groove 13 elastically abuts against the bottom wall 131 of the receiving groove 13, and the part protruding from the receiving groove 13 is for matching the buckle slot 21. When an external force acts on the elastic buckle 3, the elastic buckle 3 can slide along the extending direction of the receiving groove 13, which means the elastic buckle 3 can slide along the direction of the receiving groove 13 from the notch to the bottom wall 131, driving the part protruding from the receiving groove 13 to slide for detaching from/buckle into the buckle slot 21. Using buckle and buckle slot 21 to keep the atomizing device 2 inside the installation groove 11 is not only high reliable and hard to come out, but also easier for use. It should be explained that, in other embodiments of present disclosure, the elastic buckle 3 can be located inside the atomizing device 2, and the buckle slot 21 can be located inside the installation groove 11 correspondingly to make a disassemble connection between the atomizing device 2 and the power supply device 1. Its specific principle is the same as that of this embodiment and will not be repeated here.

Figure 5:
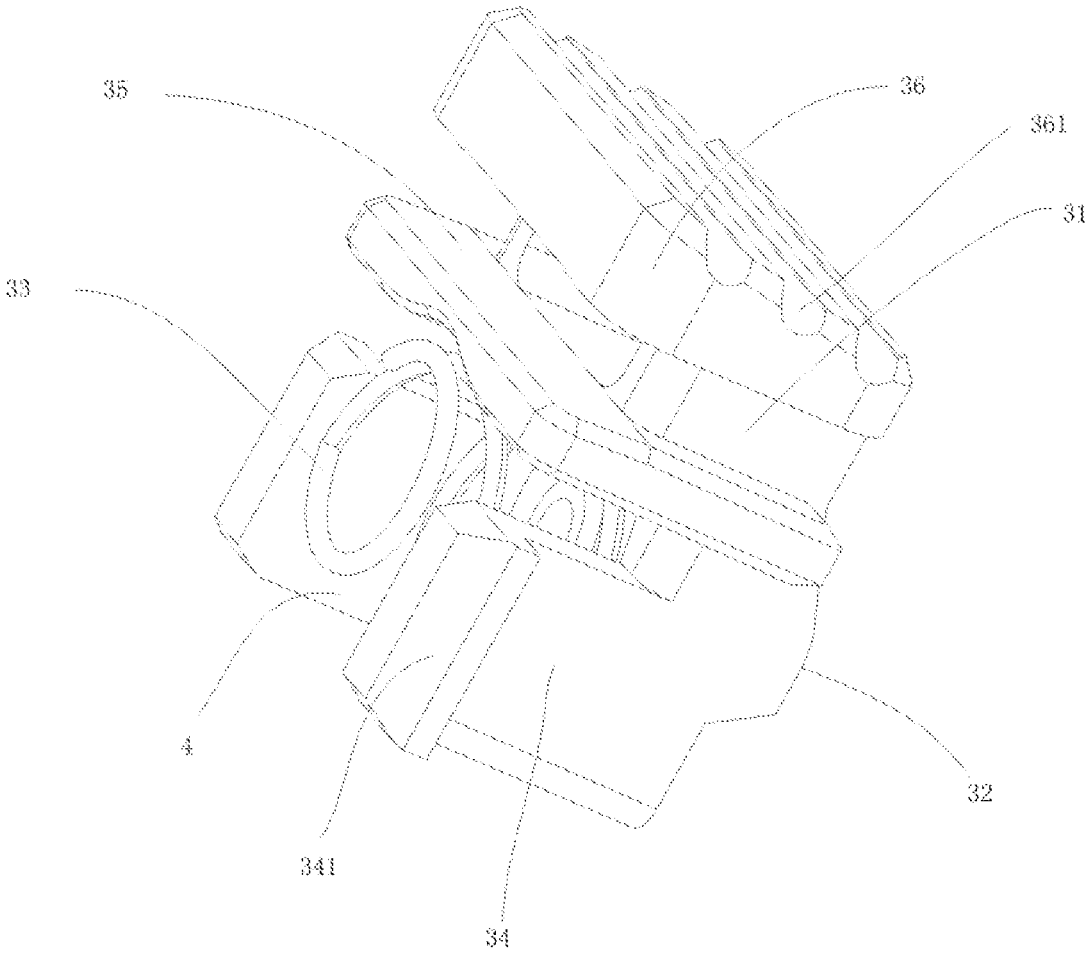
FIG. 5 is a perspective view of elastic buckle in the electronic cigarette's embodiment preferred in the present disclosure.

In this embodiment as shown in FIG. 5, the elastic buckle 3 Includes a body 31, an elastic element 33, and a buckle part 32. The body 31 locates inside the receiving groove 13. The buckle part 32 connects to one end of the body 31 near to the notch of the receiving groove 13 and protrudes from the receiving groove 13 to locate inside the installation groove 11. The buckle part 32 is provided with a guiding surface 321 and the guiding surface 321 is an angular surface. The angular surface extends along the direction from the body 31 towards the second side wall 133 to form an angle with the surface that the notch of receiving groove 13 locates. When atomizing device 2 is installed downward from the notch of installation groove, the atomizing device 2 will move down under the guidance of guiding surface 321 and press the buckle part 32 into the receiving groove 13 till the atomizing device 2 moves down to the buckle slot 21 and aligns with the buckle part 32. The buckle part 32 will protrude from the receiving groove 13 under the action of elastic element 33 to buckle into the buckle slot 21.

Please refer to FIG. 2-5, the elastic element 33 connects to one end of the body 31 near to the bottom wall of the receiving groove 13 and completely locates inside the receiving groove 13 to elastically abut against the bottom wall of receiving groove 131 and the body 31, which means the elastic element 33 has been in a compressed status. When an external force acts on the body 31, the elastic element 33 will be further compressed to drive the body 31 and the buckle part 32 to slide along the direction close to the bottom wall 131 of receiving groove 32, so that the buckle part 32 can move into the receiving groove 13 from the installation groove 11. At this time, the buckle part 32 comes out of the buckle slot 21, and the inner wall of the installation groove 11 restores even flat, so that the atomizing device 2 can be taken out smoothly and detached from the power supply device 1. When the external force is withdrawn, the elastic element 33 will restore its elastic deformability and drive the body 31 and the buckle part 32 to move towards the notch of receiving groove 13, so that the buckle part 32 can restore the status that protrudes from the receiving groove 12 to locate inside the installation groove 11. When the atomizing device 2 is installed then, the periphery of the atomizing device 2 will contact to the inner wall of the installation groove 11 tightly and press the buckle part 32 into the receiving groove 13 first, and the elastic element 33 then sequentially bounce out to buckle the atomizing device 2 into the buckle slot 21 to fix the position of atomizing device 2, preventing the atomizing device 2 from coming out of the installation groove 11.

Figure 6:
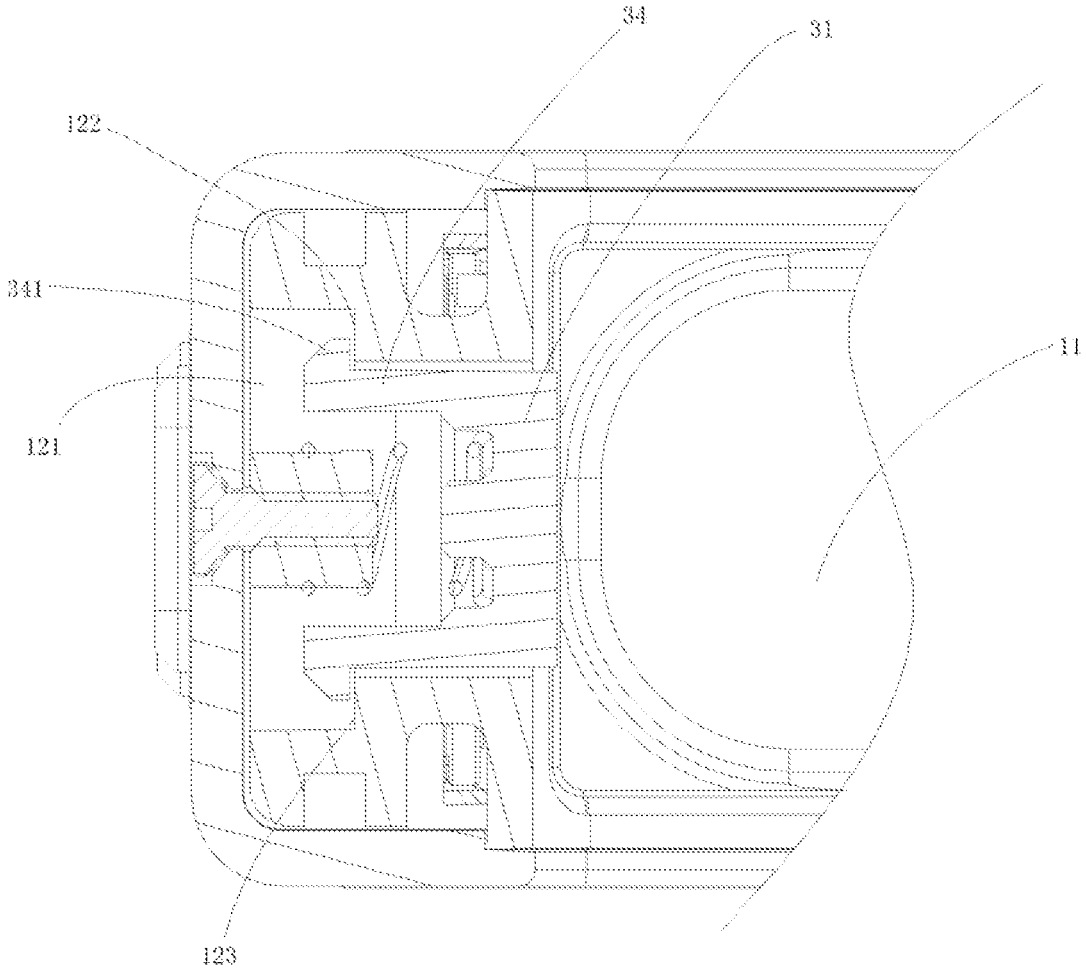
FIG. 6 is a second cross-sectional view of connection structure between the power supply device and the elastic buckle in the electronic cigarette's embodiment preferred in the present disclosure.

Furthermore, as shown in FIG. 6, the body 31 is provided with at least one first limiting element 34 on the side connecting to the elastic element 33. One end of the first limiting element 34 connects to the body 34 to form a fixed end, and the other end extends to the bottom wall 131 of the receiving groove 13 along the sliding direction of the body 31 to form a cantilever end. The cantilever end is provided with a L-shape buckle part 341 perpendicular to the extending direction of the first limiting element 34, and the L-shape buckle part 341 is bent away from the receiving groove 13. Correspondingly, the bottom wall 131 of receiving groove 13 is provided with a first limiting hole 121 matching the first limiting element 34. The first limiting hole 121 is in square shape, and its length perpendicular to the extending direction of receiving groove 13 is greater than the width of receiving groove 13. Wherein, the width of receiving groove 13 is the distance between the first side wall 132 and the second side wall 133, so that the first limiting hole 121 can form the first step 122 with the fourth side wall of the receiving groove 13 and form the second step 123 with the second side wall 133. The L-shape buckle part 341 locates inside the first limiting hole 121 and matches the first step 122. When the body 31 slides to the receiving groove 13 under a force, the L-shape buckle part 31 will detach from the first step 122; when the external force is withdrawn, the body 31 will slide towards the installation groove 11 under the resilience of elastic element 33. At this time, the L-shape buckle part 341 will move towards the first step 122 till abuts against the first step 122 to limit the rebound stroke of the elastic element 33, preventing the elastic buckle 3 from being ejected out of the notch of receiving groove 13.

Furthermore, as shown in FIGS. 3 and 5, the body 31 is provided with a second limiting element 35 on the side connecting to the elastic element 33. The second limiting element 35 is a U-shape limiting element protruding from the outer the of the body 31. Correspondingly, the inner wall of the receiving groove 13 is provided with a second limiting hole 135 matching the second limiting element 35, and the second limiting hole 135 is in U-shape matching the U-shape limiting element, which means that go-through holes are provided on the receiving groove 13's bottom wall 131, second side wall 133, and fourth side wall along the same level, and the go-through holes of adjacent inner walls communicate each other to form the U-shape hole. The U-shape limiting element locates inside the U-shape hole and can slide in the U-shape hole.

Preferably, as shown in FIG. 5, the second limiting element 35 is above or under the first limiting element 34. There are two the first limiting elements 34, and they locate on both sides of the body 31 close to both side walls, respectively. Wherein the first limiting element 34 matches the first step 122, and the other first limiting element 34 matches the second step 123, so that any force on both ends of the body 31 is even to avoid deflection during sliding of the body 34. Simultaneously, the body 31, two first limiting elements 34 on both ends of body 34, the second limiting element 35, and the receiving groove 13 form a guiding groove 4. The direction of the guiding groove 4 is opposite to that of notch of receiving groove 13. The elastic element 33 locates inside the guiding groove 4 to limit expansion/contraction of the elastic element 33 along the extending direction of the guiding groove 4 and avoid shift during expansion/contraction of the elastic element 33, resulting in deflection of the body 31 and stuck of elastic buckle 3. In practical applications, the body 31 is protrusively provided with a connecting pole, and the elastic element 33 is a spring. One end of the elastic element 33 is sleeved on the connecting pole, and the other end expanses/contracts in the guiding groove 4.

In this embodiment, the first side wall 132 of the receiving groove 13 has a gap, and one end of the body 31 is exposed from the gap for use. Furthermore, the exposed part of the body 31 is protrusively provided with a handle part 36. There is a gap between the handle part 36 and the body 31 to form a sliding groove 37. The handle part 36 is above the first side wall 132 to make the first side wall 132 locate between the handle part 36 and the body 31 and partially inside the sliding groove 37. When the handle part 36 slides towards bottom wall 131 under an external force, the handle part 36 will drive the sliding groove 37 to slide along the first side wall 132, so that the sliding direction of the elastic buckle 3 can be further limited to avoid deviation through the guiding rail function of the first side wall 132. Furthermore, the exposed part of the handle part 36 is provided with at least one notch 361 to increase the roughness of handle part 36's surface, convenient for holding. In practical applications, the handle part 36 can also be provided with some concave parts fitting for fingers for easy use.

The above is only the preferred embodiment of present disclosure, but not limit the patent scope of present disclosure. Any equivalent structural transformation that is under the inventive concept of present disclosure and made by using description and drawings of present disclosure, or directly/indirectly use such transformation in any other related technical fields are all covered by the patent protection scope of present disclosure.

What is claimed is:

1. An electronic cigarette comprising:

a power supply device comprising an installation groove that includes a protruded elastic buckle; and an atomizing device that includes a buckle slot matching the elastic buckle;

wherein the elastic buckle is operatively configured to be slid perpendicularly along an installation direction of the atomizing device;

wherein when the atomizing device is installed into the installation groove, the elastic buckle is engaged in the buckle slot to form a disassemble connection between the atomizing device and the power supply device;

wherein when the elastic buckle is slid, the elastic buckle exits the buckle slot and the atomizing device is configured to be taken out of the installation groove.

2. The electronic cigarette of claim 1, wherein the installation groove includes:

an installation base for installing the elastic buckle; and a receiving groove facing the installation groove;

wherein the elastic buckle is inside the receiving groove and elastically abuts against the bottom wall of the receiving groove;

wherein, under an external force, the elastic buckle is configured to slide along the extending direction of the receiving groove.

3. The electronic cigarette of claim 2, wherein the elastic buckle includes:

a body;

an elastic element connecting to one side of the body; and a buckle part connecting to the other side of the body;

wherein the elastic element is inside the receiving groove and elastically abuts against the body and the bottom wall of receiving groove;

wherein the buckle part protrudes from the receiving groove and is inside the installation groove;

wherein when the body slides under a force, the buckle part is configured to be pulled out and buckled into the buckle groove.

4. The electronic cigarette of claim 3, wherein one side of the body connecting to the elastic element is provided with at least one first limiting element, and the bottom wall of the receiving groove is provided with a first limiting hole matching the first limiting element, wherein the end of the first limiting element away from the body is inside the first limiting hole and is engaged with the first limiting hole to limit any displacement of the elastic buckle along the extending direction of receiving groove.

5. The electronic cigarette of claim 3, wherein the side of the body connecting to the elastic element includes a second limiting element, and the inner wall of the receiving groove includes a second limiting hole matching the second limiting element, wherein the second limiting element is inside the second limiting hole and is configured to limit any perpendicular displacement of the elastic element along the extending direction of the receiving groove.

6. The electronic cigarette of claim 5, wherein the second limiting element is a U-shape limiting element protruding from the outer side of the body, and the second limiting hole is a corresponding U-shape hole.

7. The electronic cigarette of claim 5, further comprising a first limiting element and a second limiting element, wherein each limiting element are symmetrically set at both ends of the body to form a guiding groove with the body, the second limiting element, and the receiving groove, wherein the elastic element is inside the guiding groove.

8. The electronic cigarette of claim 3, wherein the body includes a handle part, wherein the handle part is exposed from the receiving groove to form a sliding groove with the body; wherein a partial side of the receiving groove is inside the sliding groove; wherein when the handle part slides under an external force, the sliding groove is configured to slide along the side wall of the receiving groove.

9. The electronic cigarette of claim 8, wherein the surface of the handle part exposed from the receiving groove includes at least one notch.

10. The electronic cigarette of claim 2, wherein the notch of the receiving groove and the inner wall of installation groove are at a same level.

11. An electronic cigarette comprising:

a power supply device that includes an installation groove; and an atomizing device that includes a protruded elastic buckle, wherein the elastic buckle is operatively configured to be slid perpendicularly along an installation direction of the atomizing device;

wherein the installation grove includes a buckle slot matching the elastic buckle;

wherein when the atomizing device is installed into the installation groove, the elastic buckle is engaged in the buckle slot to form a disassemble connection between the atomizing device and the power supply device;

wherein when the elastic buckle is slid, the elastic buckle exits the buckle slot and the atomizing device is configured to be taken out of the installation groove.

12. The electronic cigarette of claim 11, wherein the installation groove includes:

an installation base for installing the elastic buckle; and a receiving groove facing the installation groove;

wherein the elastic buckle is inside the receiving groove and elastically abuts against the bottom wall of the receiving groove;

wherein, under an external force, the elastic buckle is configured to slide along the extending direction of the receiving groove.

13. The electronic cigarette of claim 12, wherein the elastic buckle includes:

a body;

an elastic element connecting to one side of the body; and a buckle part connecting to the other side of the body;

wherein the elastic element is inside the receiving groove and elastically abuts against the body and the bottom wall of receiving groove;

wherein the buckle part protrudes from the receiving groove and is inside the installation groove;

wherein when the body slides under a force, the buckle part is configured to be pulled out and buckled into the buckle groove.

14. The electronic cigarette of claim 13, wherein one side of the body connecting to the elastic element is provided with at least one first limiting element, and the bottom wall of the receiving groove is provided with a first limiting hole matching the first limiting element, wherein the end of the first limiting element away from the body is inside the first limiting hole and is engaged with the first limiting hole to limit any displacement of the elastic buckle along the extending direction of receiving groove.

15. The electronic cigarette of claim 13, wherein the side of the body connecting to the elastic element includes a second limiting element, and the inner wall of the receiving groove includes a second limiting hole matching the second limiting element, wherein the second limiting element is inside the second limiting hole and is configured to limit any perpendicular displacement of the elastic element along the extending direction of the receiving groove.

16. The electronic cigarette of claim 15, wherein the second limiting element is a U-shape limiting element protruding from the outer side of the body, and the second limiting hole is a corresponding U-shape hole.

17. The electronic cigarette of claim 15, further comprising a first limiting element and a second limiting element, wherein each limiting element are symmetrically set at both ends of the body to form a guiding groove with the body, the second limiting element, and the receiving groove, wherein the elastic element is inside the guiding groove.

18. The electronic cigarette of claim 13, wherein the body includes a handle part, wherein the handle part is exposed from the receiving groove to form a sliding groove with the body; wherein a partial side of the receiving groove is inside the sliding groove; wherein when the handle part slides under an external force, the sliding groove is configured to slide along the side wall of the receiving groove.

19. The electronic cigarette of claim 18, wherein the surface of the handle part exposed from the receiving groove includes at least one notch.

20. The electronic cigarette of claim 12, wherein the notch of the receiving groove and the inner wall of installation groove are at a same level.

* * * * *